United States Patent [19]

Kowalski

[11] Patent Number: 4,893,871

[45] Date of Patent: Jan. 16, 1990

[54] SWIVEL ROCKER STOP ASSEMBLY

[75] Inventor: Jerome R. Kowalski, Hickory, N.C.

[73] Assignee: Hickory Springs Manufacturing Co., Hickory, N.C.

[21] Appl. No.: 283,242

[22] Filed: Dec. 12, 1988

[51] Int. Cl.[4] ..... A47C 3/02

[52] U.S. Cl. ..... 297/270; 297/349; 248/425

[58] Field of Search ..... 297/270, 349, 263, 264, 297/269; 248/425

[56] References Cited

U.S. PATENT DOCUMENTS

| | | | |
|---|---|---|---|
| 665,005 | 1/1901 | Harmon | 297/269 X |
| 1,693,783 | 12/1928 | Hasselkus | 297/349 X |
| 2,466,081 | 4/1949 | Colvez | 297/349 |
| 2,606,594 | 8/1952 | Caldemeyer . | |
| 2,698,649 | 1/1955 | Hopkes . | |
| 2,776,703 | 1/1957 | Belisle . | |
| 2,797,737 | 7/1957 | Burton . | |
| 3,065,828 | 11/1962 | Caldemeyer . | |
| 3,190,693 | 6/1965 | Underdown, Sr. . | |
| 3,371,959 | 3/1968 | Gordin | 297/270 X |
| 3,547,393 | 12/1970 | Gordin . | |
| 3,730,585 | 5/1973 | Rogers, Jr. et al. . | |
| 3,826,532 | 7/1974 | Caldemeyer . | |
| 3,881,713 | 5/1975 | Joyce . | |
| 4,438,973 | 5/1984 | La Pointe | 297/263 |
| 4,487,452 | 12/1984 | Tanizaki et al. | 297/349 |

*Primary Examiner*—Francis K. Zugel

*Attorney, Agent, or Firm*—Shefte, Pinckney & Sawyer

[57] ABSTRACT

An apparatus for selectively disabling rocking the swiveling movement of a rocker-swivel assembly includes a pivoting member coupled to the top plate of the rocker unit and movable into engagement with the swivel base plate to prevent rocking and swiveling movement. A linkage assembly connecting a rod rotatable by the chair user and the pivoting member provides for actuating of the pivoting member into and out of such engagement. In another embodiment, the apparatus includes a threaded stem which selectively engages the top and bottom plates of the rocker unit and the swivel base plate.

15 Claims, 4 Drawing Sheets

SWIVEL ROCKER STOP ASSEMBLY

BACKGROUND OF THE INVENTION

The present invention relates generally to rocker-swivel assemblies of the type used in chair structures for providing both rocking and swiveling of a chair and more particularly relates to a stop assembly for such rocker-swivel assemblies for preventing swiveling and rocking movement.

Rocker-swivel assemblies of the aforementioned type are described, for example, in U.S. Pat. Nos. 3,190,693; 3,547,393; and 3,881,713. Such rocker-swivel assemblies typically include a rocker spring unit pivotably mounted on a swivel base plate supported by legs at a slight elevation above the floor for providing controlled rocking and swiveling capabilities to the chair mounted thereon. The rocker spring unit includes a top plate member having downwardly disposed side flanges and a bottom plate member having upwardly disposed side flanges, the two plates being fitted together so that their respective side flanges are pivotally connected to one another about a centrally disposed horizontal pivot axis. The bottom plate member of the rocker unit is pivotally connected to the swivel base plate at a centrally disposed vertical swivel axis. The rocker unit typically includes a number of vertically disposed coil springs extending between the top and bottom plates, to control the rocking movement of the chair.

While the rocking and swiveling capabilities of the chair are desirable features, there are nonetheless certain circumstances in which the chair user desires to disable the rocking or swiveling capabilities, or both, so that the chair does not move. For example, the chair user may desire to operate a keyboard while sitting in the chair and would find it irritating if not awkward to experience rocking or swiveling while operating the keyboard.

Accordingly, there exists the need for a stop assembly for disabling the rocking and/or swiveling capability of the rocker unit of a chair. Advantageously, such a stop assembly should be easily accessible to the chair user and should reliably disable the rocking and swiveling capability without creating the risk that the chair user may inadvertently disengage the stop assembly while sitting or moving in the chair.

SUMMARY OF THE INVENTION

Briefly described, the present invention provides, in a rocker-swivel assembly of the type having a rocker unit including first and second spaced rocker plates connected for relative rocking movement about a generally horizontal rocking axis and a swivel plate connected to the first rocker plate for relative rotational swiveling movement about a generally vertical swiveling axis, an apparatus including means, coupled to one of the second rocker plate and the swivel plate and movable selectively into and out of engagement with the other of the second rocker plate and the swivel plate, for selectively disabling the relative rocking movement of the rocker plates and the relative rotational movement of the swivel plate and the first rocker plate.

In one preferred embodiment, the disabling means includes a first member coupled to the second rocker plate and having a threaded portion and a second member engagable with the first rocker plate and a swivel plate and having a threaded portion engagable with the threaded portion of the first member. Preferably, the threaded portion of the first member includes internal threads and the second member is a bolt having external threads engagable with the internal threads of the first member.

In another preferred embodiment, the disabling means includes a substantially rigid member pivotally coupled to the one plate and selectively pivotable into and out of coupling engagement with the other plate for selectively preventing and permitting relative movements therebetween. Preferably, the substantially rigid member is pivotably mounted in a fixed disposition with respect to the one plate for pivoting about an axis and initial movement resisting means are provided including a bracket pivotably mounted in a fixed disposition with respect to the one plate and constrained to pivot about an axis parallel to the substantially rigid member axis, the axes of the bracket and the substantially rigid member defining a plane, and a link pivotally coupled to the substantially rigid member and the bracket at spacings from each of their respective axes, pivoting of the bracket being transmitted via the link to the substantially rigid member to pivot the substantially rigid member into and out of coupling engagement with the other plate, the bracket and the link being cooperatively arranged such that the pivot axis between the link and the bracket is moved from one side of the plane to the other by pivoting of the bracket, whereby movement of the substantially rigid member out of coupling engagement with the other plate is initially resisted. Preferably, the apparatus also includes means for biasing the link toward the one plate, the biasing means applying additional initial resistance against movement of the substantially rigid member out of coupling engagement with the other plate.

According to one aspect of the second embodiment of the present invention, the disabling means further includes the member coupled to the swivel plate and presenting a plurality of notches adjacent the periphery of the swivel plate, the notches being configured for receiving the substantially rigid member therein to prevent movement of the substantially rigid member along the periphery of the swivel plate.

DESCRIPTION OF THE PREFERRED EMBODIMENTS

Figure 1:
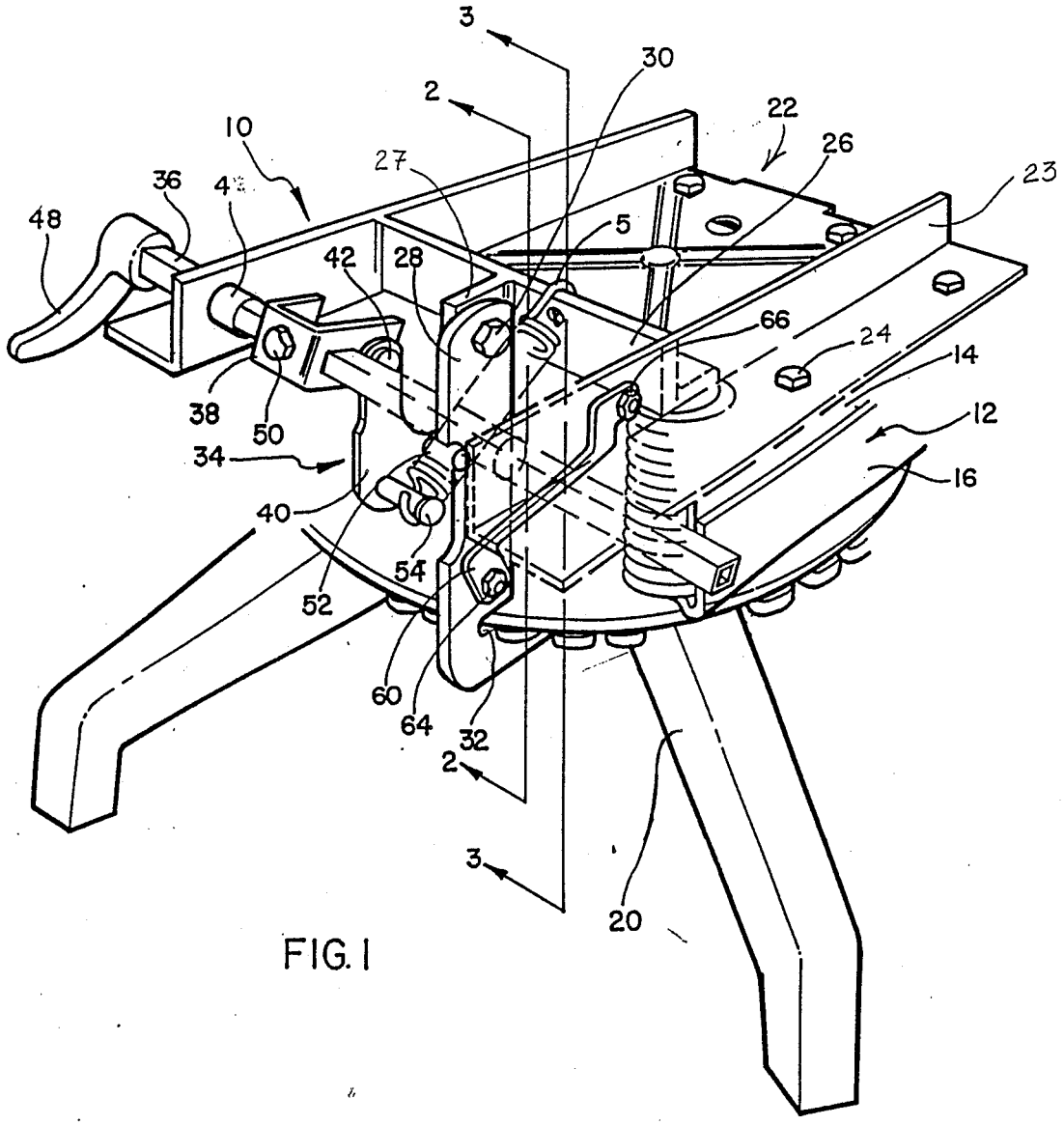
FIG. 1 is a perspective view of a rocker-swivel assembly incorporating one preferred embodiment of the present invention wherein a lock member is movable into and out of engagement with notches on the periphery of the swivel base plate by rotation of an actuating rod on the top plate member.

Referring now to the accompanying drawings and initially to FIGS. 1–4, one embodiment of a stop mechanism of the present invention is indicated generally at 10 as preferably embodied in a representative conventional rocker-swivel assembly, indicated generally at 12.

The rocker-swivel assembly 12 basically includes a rocker unit 13 having a top plate member 14 and a bottom plate member 16 disposed in spaced facing relationship and pivotally coupled about a substantially horizontal rocking axis R with a plurality of coil springs 15 biasing the plate members 14, 16 into generally parallel relation. A swivel base plate 18 is disposed in generally parallel facing relation to the underside of the bottom plate member 16 and is rotatably coupled thereto about a substantially vertical swivel axis S centrally through the bottom plate member 16 and the swivel base plate 18. A plurality of legs 20 extend from the swivel base plate 18 for supporting the entire rocker-swivel unit 12 at a slight elevation above a floor or other supporting surface.

As more fully discussed hereinafter, the present invention resides in the stop assembly 10 which, in the preferred embodiment illustrated in FIG. 1, prevents rocking movement between top plate member 14 and bottom plate member 16 and swiveling movement between rocker unit 12 and swivel base plate 18. As will be understood, the particular construction of components of stop assembly 10 may be of a wide variety of forms. However, the linkage arrangement of the preferred embodiment illustrated in FIGS. 1–4 is particularly advantageous due to its ease of use and its positive and reliable engagement operation.

Referring now in greater detail to the preferred embodiment of stop assembly 10 of FIGS. 1–4, the stop assembly includes an adapting frame 22 for coupling stop assembly 10 to rocker-swivel assembly 12. The adapting frame basically includes a pair of L-shaped side rails 23 disposed in spaced parallel relation with an interconnecting flange member 26 extending transversely between, and being affixed at its opposite ends to, the side rails 23. A plurality of bolts 24 passing through holes in the side rails 23 and corresponding holes in top plate member 14 affix the adapting frame 22 rigidly to top plate member 14. A lock member 28 is pivotally secured at its upper end by a pivot pin to a tab 27 projecting forwardly from the flange 26. The opposite end of the lock member 28 is of a hook-like shape defining a recess 32. The outwardly-facing edge of lock member 28 is recessed along a central portion of its length forming a shoulder 33. A linkage assembly 34 pivots the lock member 28 about the pivot pin 30 for movement of the free end of lock member 28 toward and away from the swivel base plate 18 in the recess 32, wherein the lock member 28 "locks" top plate member 14 to swivel base plate 18. This "locking" relationship effectively prevents top plate member 14 from its normal rocking motion relative to bottom plate member 16 and likewise prevents rocker unit 13 from its normal swiveling movement relative to the swivel base plate 18.

The linkage assembly 34 includes a rod 36 having a square cross section, a bracket 38 coupled to rod 36 and a link 40 pivotally coupled at one end to flange 38 by a link pin 42 and pivotally coupled at its other end to an intermediate location on the lock member 28 by a link pin 44. A common plane E (seen in FIGS. 2 and 3) is defined by the pivot axis of the lock member 28 through its pivot pin 30 and the rotational axis of the rod 36. As explained hereinbelow, the components of linkage assembly 34 are specifically arranged with respect to one another to translate the rotational movement of rod 36 to pivoting movement of lock member 28. Moreover, the linkage assembly 34 is so configured that the lock member 28 is prevented from being inadvertently disengaged from its locked position due to movement of the chair user in the swivel rocker or impact forces on the swivel rocker.

The rod 36 is rotatably supported in adapting frame 22 by a pair of bearings, e.g. plastic sleeves 43, each supported by a respective upwardly disposed, spaced apart flange portion of the L-shaped side rails 23. Plastic sleeves 43 are sized so that rod 36 can rotate freely therein yet without significant wobbling or skewed movement. One axial end of rod 36 is sufficiently outwardly positioned from the underside of the chair structure that the user can, while seated in the chair, easily reach a turning handle 48 attached to the axial end. Preferably, handle 48 is so positioned that it lies easily within the range of the chair user's hand swing when swinging one hand along the side of the chair.

The bracket 38 is U-shaped and includes a pair of square keyways, each on a respective leg portion thereof, sized to receive rod 36 therethrough. A tightening bolt 50 at the base portion of the bracket 38 is tightened against one side of rod 36 to thereby fixedly couple flange 38 to rod 36.

Link 40 includes a push pin 52 which cooperates with link pin 44 to move lock member 28 into locking engagement. Link 40 also includes a spring receiving pin 54 for receiving one end of a tension coil spring 56 having its opposite end secured to flange 26 on adapting frame 22. Link 40 is preferably L-shaped with link pin 42 rotatably secured adjacent one end thereof and link pin 44 rotatably received adjacent the opposite end of the link 40. As will become clear in the following discussion of the operation of linkage assembly 34, link 40 cooperates with bracket 38 and lock member 28 to prevent inadvertent loosening or disengagement of lock member 28 when it is in locking position.

The depth and height of recess 32 of lock member 28 is such that the peripheral edge of swivel base plate 18 is receivable therein in a close yet nonbinding fit. While this relatively close fit by itself enables lock member 28 to resist swiveling forces, the preferred embodiment additionally includes a plurality of peripheral notch plates 58 (best seen in FIG. 4) and an outrigger 60 (best seen in FIG. 1) to reliably insure that no swiveling movement occurs when lock member 28 is in locked position. Each peripheral notched plate 58 is fixedly secured to the underside of swivel base plate 18 and generally spans the circumferential extent of swivel base plate 18 between two adjacent legs 20. Each peripheral notch plate 58 includes a plurality of notches 62 sized slightly larger than the width of lock member 28 and adapted to receive the hook-shaped portion at the free end of lock member 28 which defines the recess 32. Outrigger 60 is pivotally attached to lock member 28 at a position slightly above recess 32 by a nut and bolt assembly 64 and is pivotally attached by another nut and bolt assembly 66 to the inward surface of one side rail of the adapting frame 22.

Preferably, each of the components of the stop assembly 10 are formed of a suitably rigid material, e.g. metal, for rigidity to facilitate reliable and secure operation.

The operation of linkage assembly 34 to move lock member 28 between its disengaged position (shown in FIG. 3), its engaged position (shown in FIGS. 1 and 2) and reversibly back to its disengaged position will now be discussed. In its disengaged position, lock member 28 is pivoted clockwise to a position in which recess 32 is spaced outwardly from and above swivel base plate 18. Due to the advantageous construction of linkage assembly 34, as discussed more fully below, lock member 28 is prevented from pivoting either toward or away from rocker unit 12 unless rod 36 is rotated. This pivot preventing feature advantageously prevents undesired movement of lock member 28 due to, for example, movement of the chair transmitted through rocker unit 12. The pivot preventing feature is provided by the disposition of the coil spring 56 extending between the central region of the link 40 and the flange member 26 adjacent the lock member pivot axis, together with the mechanical arrangement of the link pin 42 at one end of the link 40, by means of the bracket 38, for disposition of the link pin 42 at one side of (i.e. below) the common plane E when the lock member 28 is in its locked position (FIG. 2) and for disposition of the link pin 42 at the opposite side of (i.e. above) the plane E when the lock member 28 is in its unlocked disengaged position (FIG. 3). Thus, in the locked position of the lock member 28, the "over-center" disposition of the link pin 42 below the plane E enables the coil spring 56 to act on the link 40 to urge it toward the locked position while, on the other hand, in the disengaged position of the lock member 28, the "over-center" dispositioning of the link pin 42 above the plane E enables the coil spring 56 to act on the link 40 to urge it away from the locked position. In this manner, these respective "over center" positions of link pin 42 thereby insure that no rotation of rod 36, with its consequent pivoting of lock member 28, can be accidentally or unintentionally initiated in either direction by merely striking or otherwise jarring lock member 28. Furthermore, the urging action of tensioning spring 56 tends to increase during the final few degrees of rotation of rod 36 in each rotational direction so that the chair user feels a decrease in the resistance of turning rod 36. This decreasing resistance will be felt by the chair user and therefore signals the user that a slight further rotation of rod 36 will be sufficient to move the lock member 28 into the desired locking position or disengagement position, as the case may be.

Notably, during actuating movement of the lock member 28 into its locked position, one of three circumstances will arise as the recess 32 of the lock member 28 approaches the swivel base plate 18. The hook-shaped front edge of lock member 28 below recess 32 will either move into one of notches 62, contact the outer edge of one of peripheral notch plates 58 between a respective pair of adjacent nothces 62 or contact a leg 20. If the front edge of lock member 28 does continue into one of notches 62, recess 32 will receive swivel plate member 18 therein and lock member 28 will assume a generally vertical orientation. Up to this point, push pin 52 on link 40 has not yet contacted the back edge of lock member 28. However, as lock member 28 assumes its vertical, engaged position, continued rotation of rod 36 causes push pin 52 to move into contact with the back edge of lock member 28 and eventually to be received in shoulder 33 thereon.

Figure 2:
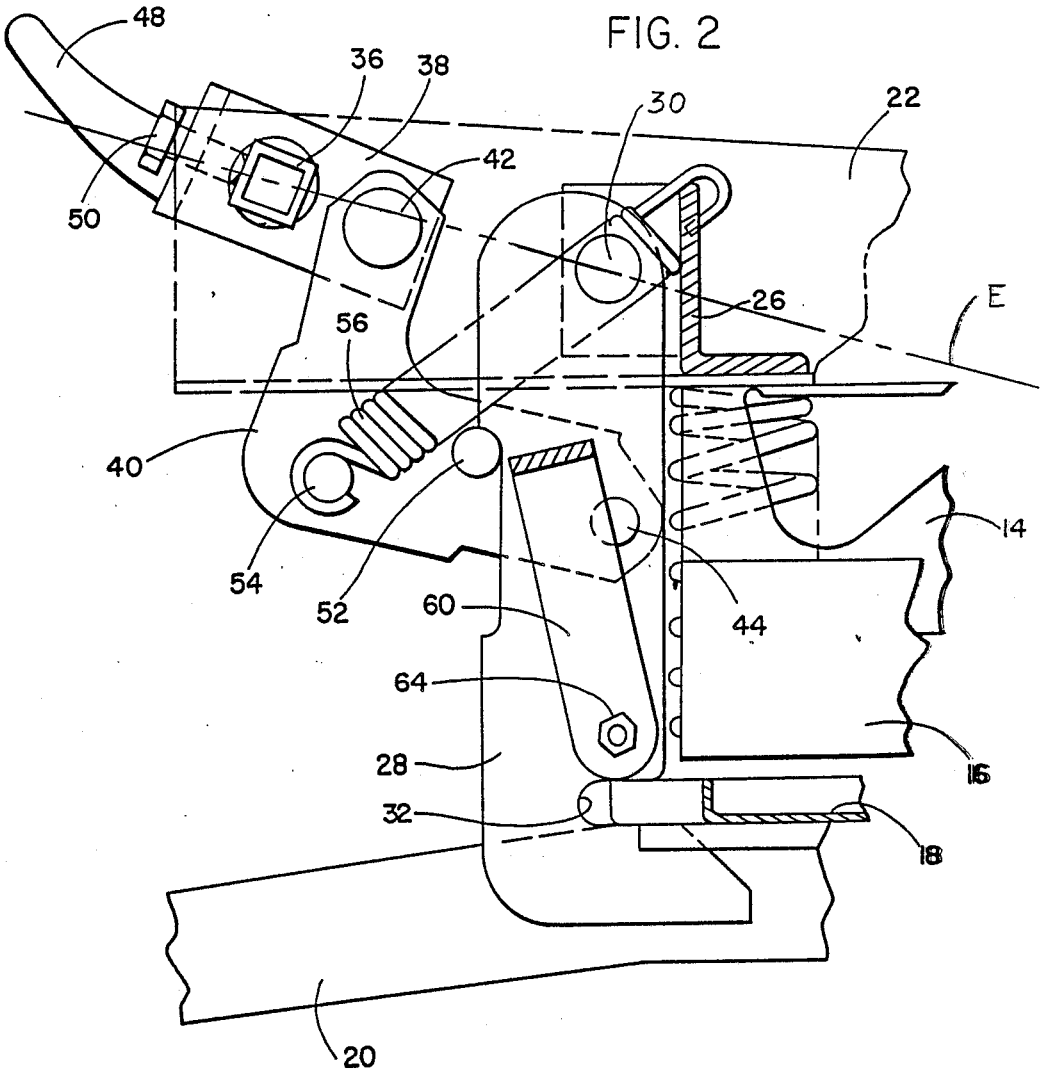
FIG. 2 is a side elevational view of the stop assembly of FIG. 1, taken along line 2—2 of FIG. 1 and showing the lock member in the locking position.
Figure 3:
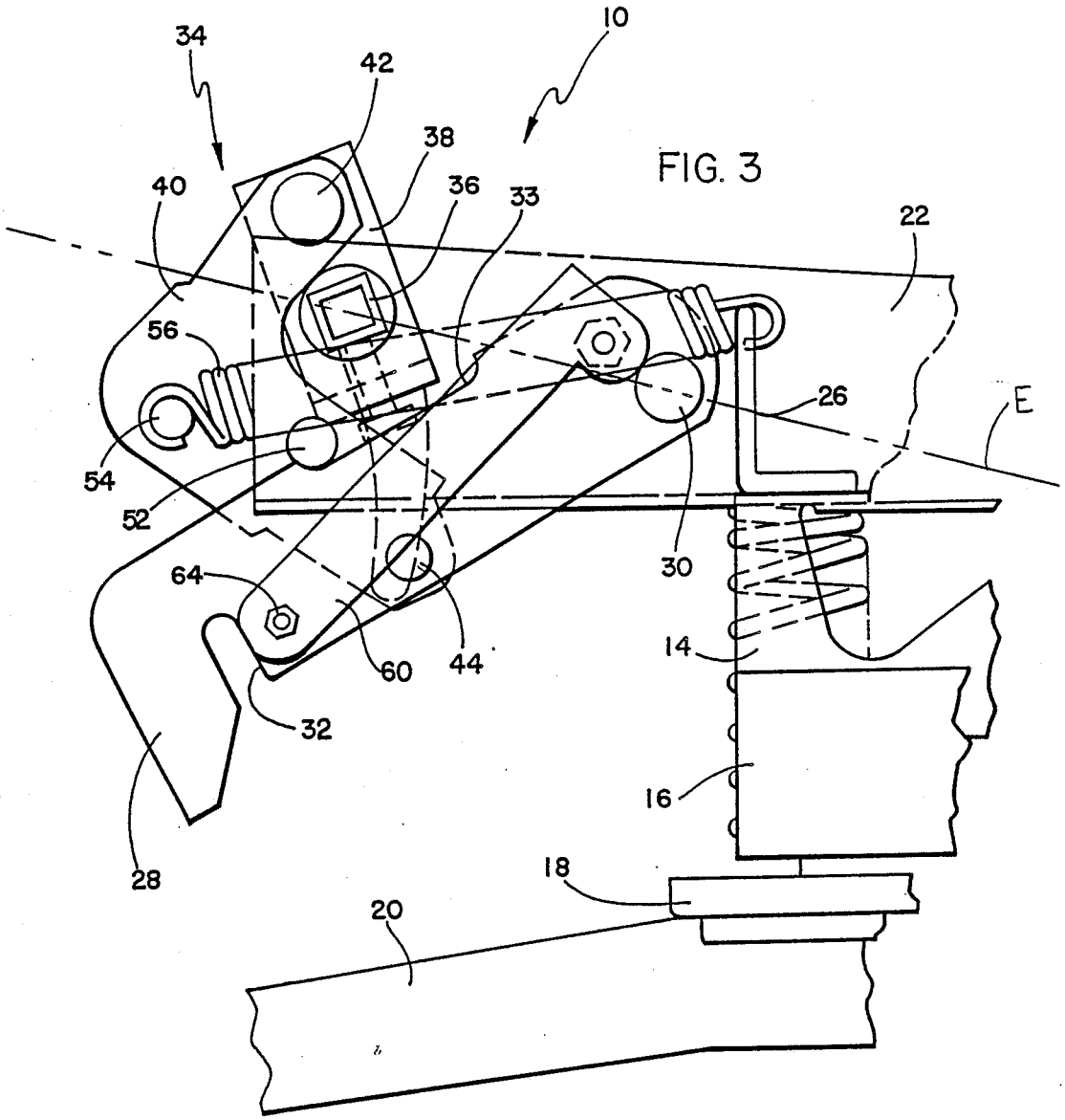
FIG. 3 is another side elevational view of the stop assembly of FIG. 1 taken along line 3—3 of FIG. 1 and showing the stop assembly after the lock member has been moved to the rest (disengaged) position.
Figure 4:
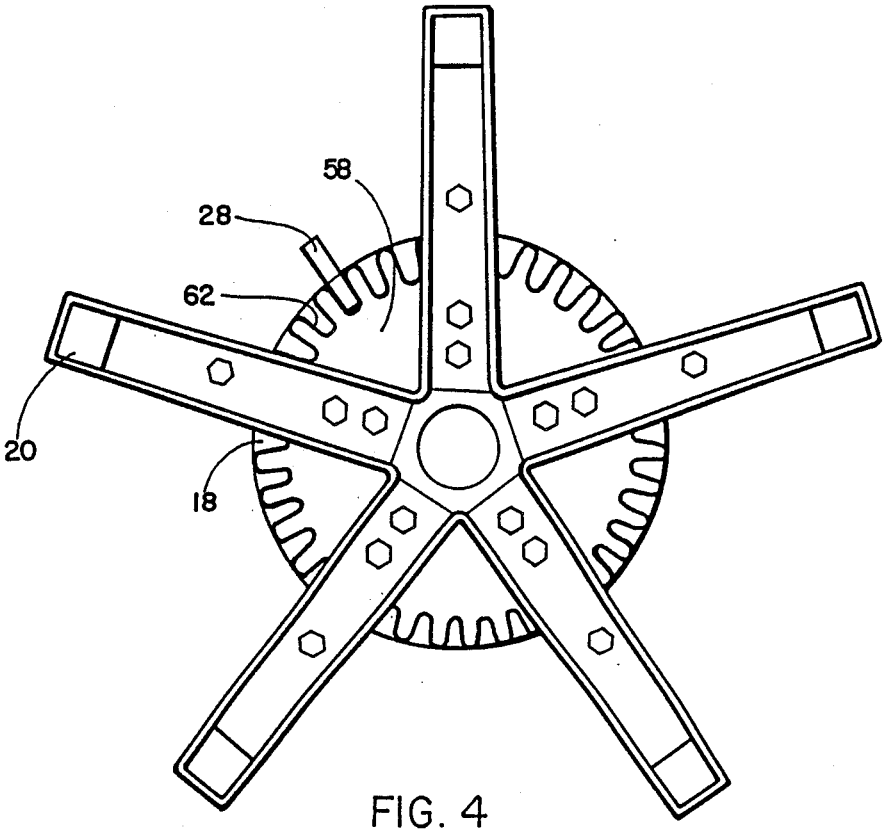
FIG. 4 is a bottom plan view of the stop assembly of FIG. 1 and showing the lock member engaged with one of the notches disposed around the periphery of the bottom of the swivel base plate.

As seen in FIG. 2, when push pin 52 is received in shoulder 33, the relative position of link pin 42 with respect to rod 36 and link pin 44 allows link 40 to prevent lock member 28 from disengaging from swivel base plate 18 without some clockwise (as viewed in FIG. 2) movement of rod 36. As above-described, this movement preventing feature is achieved because the axis of link pin 42 is in the desired "over center" position below the plane E. In this "over center" position, any clockwise movement of lock member 28 away from swivel base plate 18 is transmitted through push pin 52 to link 40, which in turn transmits the movement through link pin 42 to flange 38. However, the orientation of flange 38, link pin 42 and link pin 44 are such that the coil spring 56 urges the components to remain in the locked position so that clockwise pivoting movement of lock member 28 is resisted. It should be noted that even if stop apparatus 10 did not include push pin 52, the movement preventing feature would still be achieved in the same manner.

In the second circumstance where the front edge of lock member 28 contacts one of peripheral notch plates 58 between a respective pair of notches 62, the chair user need only swivel the chair slightly in either direction to bring the front edge of lock member 28 into alignment with a notch 62 whereupon tension spring 56 automatically urges the lock member 28 into the notch. Moreover, the urging of tension spring 56 is sufficient to enable link pin 42 to complete its clockwise rotation and assume its "over center" position in which lock member 28 is prevented from movement without further rotation of rod 36. Likewise, in the third circumstance in which lock member 28 encounters a leg 20 during its pivoting movement toward swivel base plate 18, the chair user need only swivel the chair slightly to the right or left to enable tensioning spring 56 to urge the lock member 28 into engagement with a notch 62.

Figure 5:
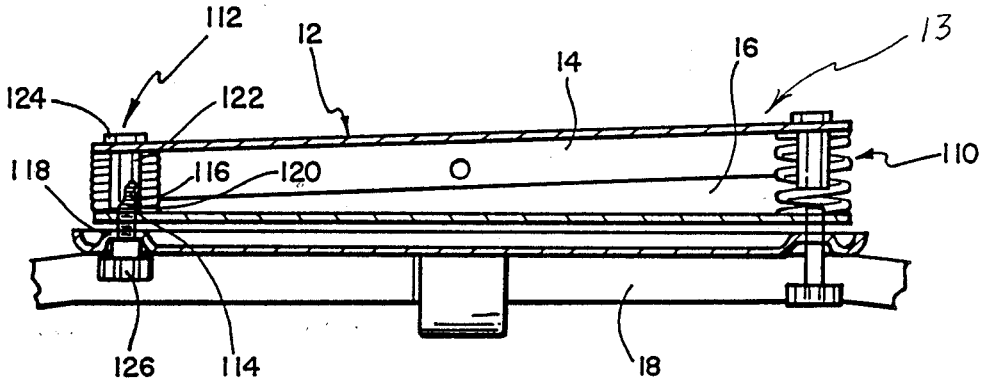
FIG. 5 is a side elevational view in vertical cross section of another embodiment of the stop assembly of the present invention.

With reference now to FIG. 5, a second preferred embodiment of the apparatus of the present invention is illustrated wherein a stop assembly, generally indicated at 110, is incorporated in a conventional type of rocker-swivel assembly 12 identical to that of FIGS. 1–4. Preferably, the stop assembly 110 includes a pair of threaded stem assemblies 112, although as explained more fully below, stop assembly 110 need only include one threaded stem assembly 112 to achieve the rocking and swiveling stop features of the present invention. Moreover, in contrast to the stop assembly 10 of the first embodiment, stop assembly 110 can be operated selectively to prevent only swiveling movement of the rocker-swivel assembly without disabling its rocking movement or to prevent both rocking and swiveling movements of the rocker-swivel assembly.

Each threaded stem assembly 112 includes a stem 114 having external threads 116, a threaded bore 118 in swivel base plate 18, a threaded bore 120 in bottom plate member 16 and a receiving portion 122 coupled to top plate member 14 by bolt 124. Bores 118 and 120 and receiving portion 122 are internally threaded for threadably receiving stem 114. Stem 114 also includes a hand knob 126 fixedly attached to its lower axial end.

Stem 114 has an axial length which permits it to be threaded upward through bores 118 and 120 and into receiving portion 122. Receiving portion 122 has an axial length less than the distance between top plate member 14 and bottom plate member 16 when the two plate members are parallel. Additionally, the axial lengths of receiving portion 122 and stem 114 are such that stem 114 can be lowered to its lowermost position in which it only engages threaded bore 118 in the swivel base plate 18 without hand knob 126 contacting the surface on which legs 20 rest while still allowing stem 114 to be threaded to its uppermost position in which it engages both bore 120 and receiving portion 122.

As noted above, each threaded stem assembly 112 can be operated to selectively disable both the rocking capability and the swiveling capability of the rocker-swivel assembly 12, or only its swiveling capability. To disable only the swiveling movement of the chair while still allowing rocking movement, the user rotates hand knob 126 to raise stem 114 from its lowermost position, in which it is threadably retained only in bore 118, to a position in which it threadably engages bore 120 on bottom plate 16. However, the threaded axial end of stem 114 is not raised so far as to engage receiving portion 122 on top plate member 14. As can be understood, the engagement of stem 114 with bottom plate member 16 prevents rocker unit 13 from swiveling relative to swivel base plate 18 while still permitting top plate member 14 to pivot on bottom plate member 16. Stem 114 is advantageously threaded beyond bore 120 by only a small amount so that the space between the axial end of stem 114 and receiving portion 122 is sufficient to permit top plate member 14 to pivot on bottom plate member 16 through a desirable range without contact between receiving portion 122 and stem 114.

To prevent the swivel rocker from both swiveling and rocking, the chair user need only further rotate hand knob 126 to raise stem 114 upward through bores 118 and 120 and into receiving portion 122. Now, relative movement between top plate member 14 and bottom plate member 16 is prevented as well as relative movement between rocker unit 13 and swivel base plate 18. Thus, when the swivel chair is subjected to impact forces, such as a user sitting on the chair, stem 114 continues to prevent rocking or swiveling. Threaded stem assembly 112 can only be engaged or disengaged by rotation force applied to hand knob 126.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foreging description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a rocker-swivel assembly of the type having a rocker unit including first and second spaced rocker plates connected for relative rocking movement about a generally horizontal rocking axis and a swivel plate connected to said first rocker plate for relative rotational swiveling movement about a generally vertical swiveling axis, the improvement comprising means, coupled to one of said second rocker plate and said swivel plate and movable selectively into and out of a locking disposition in gripping engagement with the other of said second rocker plate and said swivel plate, for selectively disabling both said relative rocking movement of said rocker plates and said relative rotational movement of said swivel plate and said first rocker plate, and manually-operable actuating means connected to said disabling means for selectively manipulating movement thereof into and out of said locking disposition.

2. An apparatus according to claim 1 and characterized further in that said disabling means includes a first member coupled to said second rocker plate and having a threaded portion and a second member engagable with said first rocker plate and said swivel plate and having a threaded portion engagable with said threaded portion of said first member.

3. An apparatus according to claim 2 and characterized further in that said threaded portion of said first member includes internal threads and said second member is a bolt having external threads engagable with said internal threads of said first member.

4. An apparatus according to claim 3 and characterized further by second means for disabling said relative rocking and rotational movements.

5. An apparatus according to claim 1 and characterized further in that said disabling means includes a substantially rigid member pivotally coupled to said one plate and selectively pivotable into and out of coupling engagement with said other plate for selectively preventing and permitting said relative movements therebetween.

6. An apparatus according to claim 5 and characterized further in that said disabling means further includes means for initially resisting movement of said substantially rigid member from its dispositions in engagement and out of engagement with said other plate.

7. An apparatus according to claim 6 and characterized further in that said substantially rigid member is pivotally mounted in a fixed disposition with respect to said one plate for pivoting about an axis and said initially resisting movement means includes a bracket pivotably mounted in a fixed disposition with respect to the one plate and constrained to pivot about an axis parallel to said substantially rigid member axis, the axes of said bracket and said substantially rigid member defining a plane, and a link pivotally coupled to said substantially rigid member and said bracket at spacings from each of their respective axes, pivoting of said bracket being transmitted via said link to said substantially rigid member to pivot said substantially rigid member into and out of coupling engagement with said other plate, said bracket and said link being cooperatively arranged such that the pivot axis between said link and said bracket is moved from one side of said plane to the other by pivoting of said bracket, whereby movement of said substantially rigid member out of coupling engagement with said other plate is initially resisted.

8. An apparatus according to claim 7 and characterized further by means biasing said link toward said one plate, said biasing means applying additional initial resistance against movement of said substantially rigid member out of coupling engagement with said other plate.

9. An apparatus according to claim 8 and characterized further in that said substantially rigid member is pivotally mounted in fixed disposition with respect to said second rocker plate and is pivotable into coupling engagement with said swivel plate.

10. An apparatus according to claim 9 and characterized further in that said disabling means further includes a member coupled to said swivel plate and presenting a plurality of notches adjacent the periphery of said swivel plate, said notches being configured for receiving said substantially rigid member therein to prevent movement of said substantially rigid member along the periphery of said swivel plate.

11. An apparatus according to claim 10 and characterized further in that said disabling means further includes an outrigger pivotally coupled to said substantially rigid member and pivotally coupled to said second plate.

12. An apparatus according to claim 11 and characterized further in that said biasing means further includes a tension spring coupled at one end to said link and at its opposite end in fixed disposition with respect to said second rocker plate.

13. An appartus according to claim 12 and characterized further in that said bracket is fixedly mounted on a rod which is rotatably mounted for rotation about an axis fixed with respect to said second plate and said rod includes a handle.

14. An apparatus according to claim 13 and characterized further in that said substantially rigid member includes a recess for engaging said swivel plate.

15. An apparatus according to claim 14 and characterized further in that said link includes a push pin for contacting said substantially rigid member and said substantially rigid member includes a shoulder for receiving said stop pin thereagainst.

* * * * *